US005735481A

United States Patent [19]

Loosen

[11] Patent Number: 5,735,481

[45] Date of Patent: Apr. 7, 1998

[54] DEVICE FOR WINDING CONTINUOUS-STRIP ROLL-FED MATERIAL

[75] Inventor: Reinhard Loosen, Krefeld, Germany

[73] Assignee: Ramisch Kleinewefers GmbH, Krefeld, Germany

[21] Appl. No.: 611,127

[22] Filed: Mar. 5, 1996

[30] Foreign Application Priority Data

Mar. 6, 1995 [DE] Germany ..... 195 07 799.7

[51] Int. Cl.[6] ..... B65H 19/26; B65H 19/28; B65H 19/30

[52] U.S. Cl. ..... 242/526.1; 242/533.6; 242/532.3; 242/580

[58] Field of Search ..... 242/533.4, 533.5, 242/533.6, 532.3, 526.1, 527.2, 580

[56] References Cited

U.S. PATENT DOCUMENTS

| | | | |
|---|---|---|---|
| 3,930,620 | 1/1976 | Taitel . | |
| 4,160,529 | 7/1979 | Hutzenlaub et al. | 242/532.3 |
| 4,279,687 | 7/1981 | Buchholz et al. | 156/568 |
| 4,338,147 | 7/1982 | Backstrom et al. | 242/532.3 |
| 4,648,562 | 3/1987 | Kiuchi | 242/533.6 |
| 4,711,405 | 12/1987 | Niskanen | 242/532.3 |
| 4,775,110 | 10/1988 | Welp et al. | 242/532.3 |
| 4,790,491 | 12/1988 | Mundus et al. | 242/533.6 |

FOREIGN PATENT DOCUMENTS

| | | |
|---|---|---|
| 66 01 235 | 11/1968 | Germany . |
| 22 11 076 | 9/1973 | Germany . |
| 23 61 343 | 6/1974 | Germany . |
| 25 58 424 | 5/1977 | Germany . |
| 28 25 154 | 12/1979 | Germany . |
| 25 23 318 | 9/1987 | Germany . |
| 46-10305 | 3/1971 | Japan . |
| 48-95075 | 8/1972 | Japan . |
| 51-42139 | 11/1976 | Japan . |
| 61-52658 | 4/1986 | Japan . |
| 61-101357 | 5/1986 | Japan . |
| 61-124478 | 6/1986 | Japan . |
| 63-147754 | 6/1986 | Japan . |
| 5-186111 | 7/1993 | Japan . |
| 6-78142 | 10/1994 | Japan . |
| 7-206231 | 8/1995 | Japan . |

*Primary Examiner*—John M. Jillions
*Attorney, Agent, or Firm*—Darby & Darby

[57] ABSTRACT

A device for winding a continuous strip of roll-fed material, reeled off a mother roll, sequentially onto several winding tubes. The winding tubes are mounted on rolling spindles provided on a rotatable carrier mount that permits timed angular rotation of the winding tubes through various stations in which the winding tubes are processed and wound with material. The rolling spindles are preferably mounted at essentially identical angular distances. Two drive units drive the rolling spindles individually or in groups, so that neighboring rolling spindles are operated by different drives. Accordingly, the rotational speeds of winding tubes sequentially entering a winding station may be independently controlled. The winding device thus can achieve greater winding speeds than other prior art winding devices. A glue application device that applies glue helically around the winding tubes is also provided. Additionally, a cutting device is provided for perforating the strip of material to provide a cleaner cut than in prior an devices.

20 Claims, 2 Drawing Sheets

DEVICE FOR WINDING CONTINUOUS-STRIP ROLL-FED MATERIAL

BACKGROUND OF THE INVENTION

The present invention relates to a device for the continuous spooling or winding of strip- or web-type roll material, reeled off a mother roll, onto several sequentially presented winding tubes on a carrier mount that is rotatable at timed intervals. The carrier mount includes, at essentially identical angular distances, several rolling spindles that carry the winding tubes through several stations in succession as the carrier is rotated.

Devices of this type are also referred to as small-roll winding machines. They are used primarily for reeling aluminum foil or plastic wrap, household paper such as sandwich wrap, baking sheet liner, and the like off a mother roll and winding the material onto smaller rolls which are also known as "short rolls," "household rolls," "catering rolls" or "dispenser rolls." The material in this case is fed off larger mother/supply rolls which are approximately 3 feet (1 m) or more in diameter. The finished household rolls usually have a diameter of about 1.6" (40 mm) to about 4" (100 mm) depending on the length of the material they carry. The length of material on the roll may be as short as 40" (1 m) or as long as several hundred yards (100 m).

The basic mode of operation of this type of winding machine is well known. The leading edge of the strip of material to be wound is attached to a winding tube which is positioned on a rolling spindle inside a winding station. In this case, the circumferential speed of the winding tube should correspond to the travel speed of the strip of material to be wound. The strip of material attached to the winding tube is then wound onto the latter at the desired length. The carrier mount is then rotated whereby a new winding tube is brought into contact with the strip of material. Thereupon the strip of material is cut between the two winding tubes and the winding process shifts over to the new winding tube. The finished roll is capped or sealed and moved on for further processing, such as packaging.

An example of a device of this type is described in DE 25 23 318 C2. In that design, the rolling spindles are firmly connected with friction wheels. In the winding station the friction wheel bears on a drive wheel which is continuously driven by a drive motor via a drive belt. As soon as the rolling spindle moves away from the winding station, the friction wheel is swiveled clear of the drive wheel which thus stops the rotation of the winding tube.

Another example is described in DE 28 25 154 A1. In that design, the rolling spindles are rotated by a drive motor via a drive belt. As the carrier mount is rotated, the drive disk of the rolling spindle positioned in the winding station engages in the drive belt and is thus brought up to speed. The attachment of the strip of material to the winding tube is brought about by vacuum action. To that end, the winding tubes are perforated before they are mounted on the rolling spindles. Through these perforations the vacuum causes the material to cling to the winding tube.

In both above-described designs, a compensating rocker arm is provided for keeping the tension on the material as even as possible.

Yet another drive mode is described in the German patent disclosure (DE-OS)22 11 076. In that design, two contact drive cylinders bear on the circumference of the winding tube, thus causing the winding tube to rotate. Since the strip of material is continuously pushed in the winding direction, the resultant rolls are wound in relatively loose fashion and tend to telescope.

What these earlier designs have in common is that their spooling or winding speed is limited. The device last mentioned will work satisfactorily at a maximum rate of about 655 feet/minute (200 m/min). The system described in DE 25 23 318 C2 reportedly permits winding speeds of up to 1,310 ft/min (400 m/min); in reality, however, it is evident that the maximum obtainable speed is only around 1,180 ft/min (360 m/min).

Greater speeds pose problems insofar as there is only a relatively short time available for the acceleration and deceleration of the rolling spindles. If the new winding tube to be rolled has not yet reached full rotational speed at the time that it makes contact with the strip of material, there will either be a jerky pull resulting, in many cases, in an uneven start of the winding process and a correspondingly poor winding pattern, or the mother roll has to be decelerated and accelerated periodically which leads to problems with it.

SUMMARY OF THE INVENTION

It is therefore an object of the present invention to provide a winding device that permits the spooling of rolls at winding speeds of at least up to 1,968 ft/min (600 m/min).

It is a related object of the present invention to provide a winding device that permits independent control of the rotational speeds of individual rolling spindles that carry the winding tubes on which material is to be wound.

It is a further related object of the present invention to provide a control system which controls the rotational speed of the spindles as a function of winding status, i.e., the location of the spindles with respect to the stations of the winding device.

It is a further object of the present invention to provide a glue application station that evenly distributes glue along the length and circumference of the winding tube.

It is an even further object of the present invention to provide a winding device that tensions the wrapped material and cuts the wrapped material smoothly, and then applies a sealing label only at the cut end of the wrapped material.

These and other objects of the invention are accomplished in accordance with the principles of the present invention by providing a winding device having a carrier mount supporting a plurality of spindles driven by at least two independently operated drive systems. The rolling spindles thus may be operated individually or in groups, with neighboring rolling spindles being driven by different drive systems. Using several drives, perhaps incorporating several motors, makes it possible to control the rotational speed of the individual rolling spindles independently of one another. A rolling spindle can thus be brought up to the necessary speed prior to entering the winding station. In this context, the acceleration of a rolling spindle to be positioned in the winding station can be performed by its separate drive system without interfering with the winding of the spindle currently in the winding station, because the latter is driven by a different drive system. Because the individual drive units no longer need to perform both the winding and the acceleration processes at the same time (as in the prior art, in which the same drive unit wound and accelerated the spindles), the acceleration times can be shortened. Accordingly, the winding speed can be held steadier, which not only improves the quality of the rolls produced but also permits greater speeds. The improved design in turn permits the winding of rolls having a greater diameter than those produced by prior art winding devices. The even, smooth movement of the strip of material prevents irregular dereeling of the mother roll which largely obviates the need for accelerating or decelerating the mother roll. And because the inertia of the mother roll is no longer a factor to be considered, it is now possible to use mother rolls with a larger diameter than those used in prior art devices.

Ideally, the rolling spindles are at all times firmly engaged in the drive system assigned to them. This means that all rolling spindles operated by the same drive are turning simultaneously. That, however, is acceptable in view of the fact that friction and slippage along with corresponding wear and tear are eliminated. Besides, in this type of power transmission the rotational speed of the rolling spindles is easier to control. There is virtually no slippage between the drive and the rolling spindle.

The drive power rate is the product of torque and number of revolutions. The torque is determined primarily by the tension on the strip of material. Preferably, the drives operate at alternating augmented and reduced power rates such that at any one time at least one drive runs at the reduced rate. The drive performing the winding process operates at a high winding torque and, due to the high speed, at a high number of revolutions as well, and thus at a high power rate. The other drive normally operates at a lower number of revolutions and especially at a substantially lower opposing torque, and thus at a lower power rate. In the acceleration phase of a rolling spindle, the power rate is lower than during the winding process even though the number of revolutions increases because the torque needed to accelerate an empty winding tube is in most cases less than the torque needed for winding a roll. Accordingly, because not all drives always operate at maximum power at the same time, a corresponding dimensional reduction of the drive-system power supply (which must be dimensioned to provide the necessary maximum power level in all situations that may be encountered) is possible. A multiplication of the installed power rate (i.e., a multiplication of the maximum energy consumption of a drive motor by the number of motors in order to establish the total power requirement) therefore is not necessary. It follows that in many cases the power supply, whether electric, pneumatic or hydraulic, need not be greater than that used in conventional designs.

The control system of the present invention preferably controls the drives as a function of the winding status, i.e., the location of the spindles with respect to the various processing stations of the winding device. This allows running the drives flexibly over a wide segment of their rotational speed range and adapting the winding speeds to the individual processing stages.

The winding device of the present invention preferably includes, in addition to a winding station, at least one processing station and at least one idling station. While they are in idling stations, the spindles require no further action, such as inserting an empty winding tube, capping the finished roll, or discharging the roll. In other words, the rolling spindles in the idling stations can turn essentially unimpeded by external factors. Preferably, the rolling spindles directly driven by the same drive as the rolling spindle currently in the winding station are positioned strictly in idling stations, if in any station at all. That allows the drive of the rolling spindle currently in the winding station to be controlled with exclusive emphasis on the fastest possible winding of the roll. The other idle rolling spindles connected to the same drive are free to turn at the same speed. In the processing stations, however, a different drive is active. Thus, the rotational speed of the winding tubes in the processing stations can be adapted to the process that is to take place in the various processing stations without affecting the rotational speed of the tube in the winding station. It is not necessary for all of these processes to be performed at the same rotational speed. Rather, the speed of the drive concerned can be progressively adapted to the processes in the various processing stations because, overall, there is as much time available as that needed for completion of the roll in the winding station.

The drive systems of the present invention preferably permit angular control. This makes it possible, where necessary in the individual processing stations, to rotate the carrier mount to position the winding tubes or finished rolls at the circumferential angular position desired for the process concerned.

In a preferred design version, the processing stations of the winding device of the present invention include a glue application station equipped with at least one glue jet. The glue jet sprays glue on the winding tube positioned in the glue application station. The spray method permits the application of a very thin coat of glue which leaves next to no trace on the strip of material. The leading edge of the strip of material thus instantly and neatly attaches to the empty winding tube without any sort of "glue crease." Accordingly, each added layer of material hugs the winding tube or the preceding layer of material more smoothly and evenly, which in turn favors a higher winding speed.

It is desirable to configure the glue jet so as to be movable in the axial direction along the revolving winding tube. This permits helical application of the glue over the circumferential surface of the tube. Such spiral gluing assures instant adhesion of the material to the tube regardless of the angle of contact between the winding tube and the strip of material. Moreover, on average, the glue is evenly distributed both over the length of the tube and around its circumference which again results in an improved attachment of the starting end of the roll.

Another of the processing stations of the winding device of the present invention is preferably designed to serve as a capping or sealing station equipped with a label dispenser which places a capping or sealing label at the free, cut-off end of the strip of material on the outer surface of the roll. The label straddles the cut-off edge of the strip of material so that part of the label adheres to the end of the strip while the other part adheres to the circumference of the roll (over the remaining material wrapped on the roll). A label of this type is often more easily removed than a banderole that completely surrounds the finished roll. Detecting the end or trailing edge of the strip of material can be accomplished in various ways. In general, the point at which the strip is to be cut, and thus the distance between the end of the cut strip and the roll at the time the cutting takes place, is a known factor. It is also a fairly simple matter to determine the circumference of the finished roll, so that the drive system can easily be controlled in a way that the end of the strip of material on the fully wound roll is positioned precisely underneath the label dispenser, or at least in a way that the label can be attached as needed.

The cutter of the present invention is preferably designed to incorporate a plurality of pointed side-by-side pins, the points of which are spaced less than 1 mm apart. At higher winding speeds, conventional sawtooth blades with triangular teeth having a pitch greater than 1 mm produce ragged cuts. The greater the winding speed, the more frayed the cut, with progressively longer serrated fringes. Such long fringes make it difficult for the consumer to open the roll or indeed make it impossible to open it without some damage. The use of pins as disclosed in the present invention avoids cutting the strip. Instead, the strip is closely perforated. Given the most commonly used strip tension levels, such perforation is often enough to cause the strip to "tear off." The resulting edge is relatively smooth, with only short serrations.

To further improve the cut, provisions can be made in another preferred design version for a strip tensioning device which interacts with the cutting unit in a way that the tension on the strip is increased during or just before the cutting process. As the pins penetrate the material, the increased tension will result in a clean separation.

The above and other objects, features, and advantages of the present invention will be readily apparent from the following detailed description of the invention taken in conjunction with the accompanying drawings, wherein like reference characters represent like elements, the scope of the invention being set out in the appended claims.

DETAILED DESCRIPTION OF THE INVENTION

Figure 1:
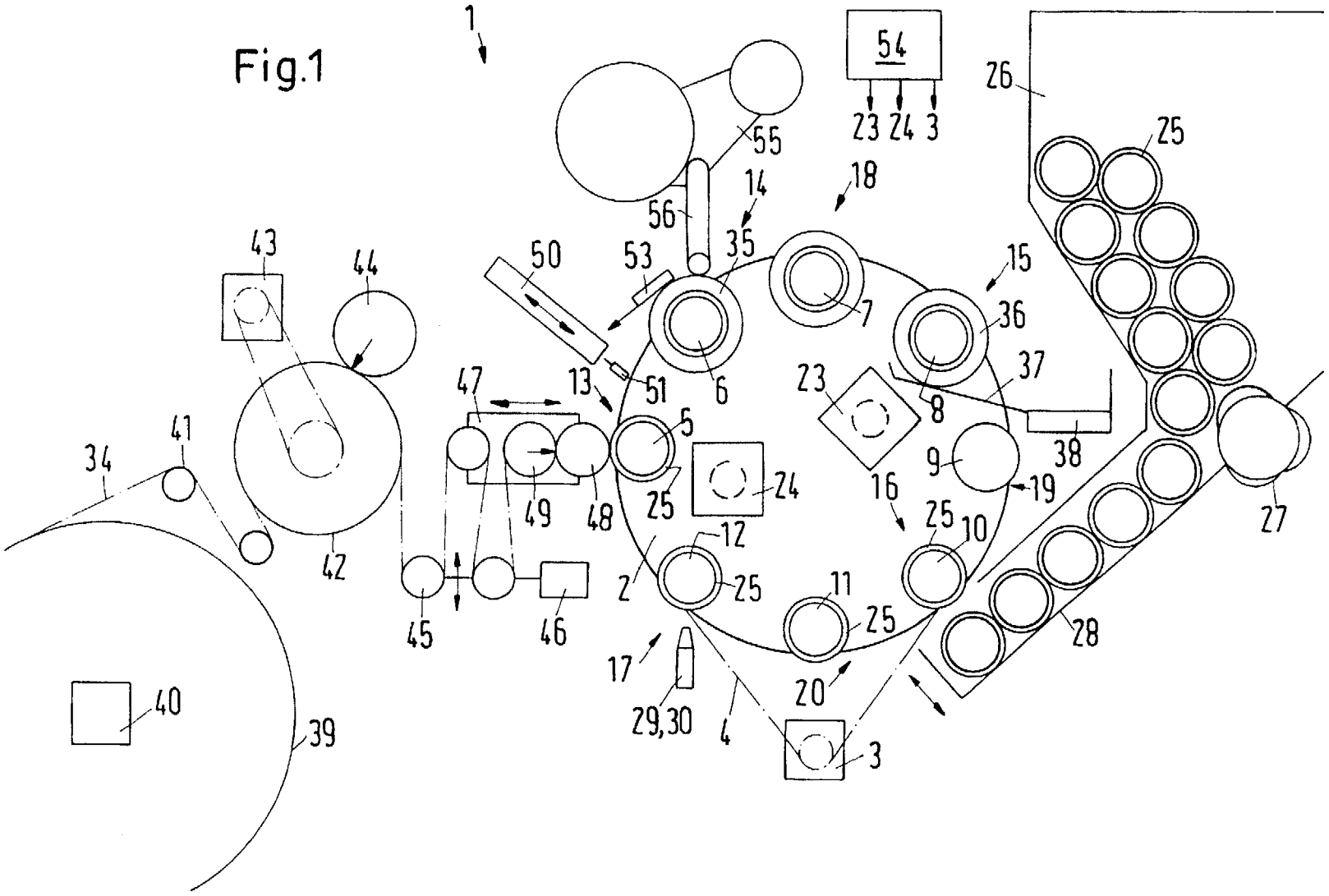
FIG. 1 is a schematic view of a device for winding continuous strips of material in accordance with the principles of the present invention.

A winding device 1, formed in accordance with the principles of the present invention, is shown in FIG. 1. Winding device 1 incorporates a carrier mount 2 which can be rotated in timed fashion by a motor 3 driving a chain or belt 4. Each rotation takes place at a predetermined angle, which, in the embodiment of FIG. 1, is 45°. Accordingly, the carrier mount 2 supports eight rolling spindles 5–12 arranged at identical angular distance from one another, in this case 45°.

The carrier mount 2 is surrounded by several stations through which the individual spindles 5–12 pass in clockwise fashion. The stations include a winding station 13, a sealing station 14, a discharging station 15, a feeder station 16, a glue application station 17, and three idling stations 18, 19, and 20. Sealing station 14, discharging station 15, feeder station 16, and glue application station 17 are collectively referred to as processing stations. It can be seen that between any two of the individual processing stations 14, 15, 16, 17, there is always a nonprocessing station, i.e., either one of the idling stations 18, 19, 20, or the winding station 13. The reason for the placement of the stations will be evident from FIG. 2, which shows the carrier mount 2 with the rolling spindles 5–12.

Figure 2:
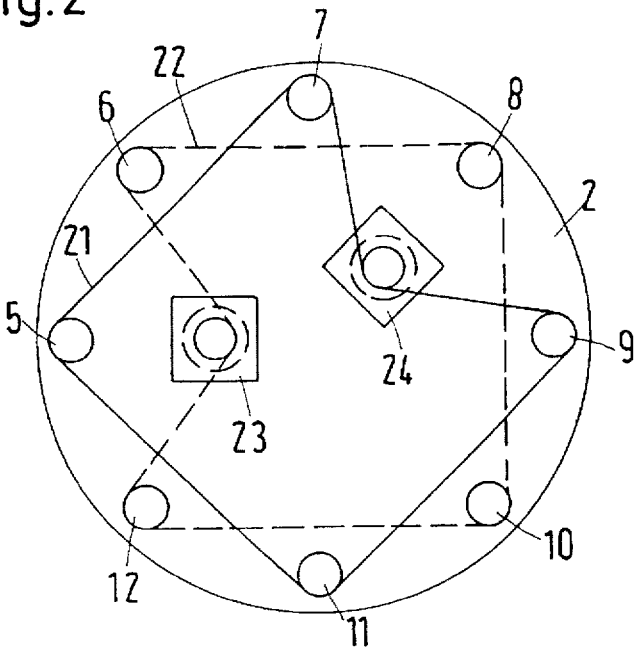
FIG. 2 is a schematic view of a carrier mount with several rolling spindles.

In the embodiment of the invention shown in FIG. 2, the rolling spindles are subdivided into two groups. A first group includes rolling spindles 5, 7, 9, 11; a second group includes rolling spindles 6, 8, 10, 12. Spindles 5, 7, 9, 11 of the first group are firmly, positively connected, via timing belt 21, to first drive 23. Spindles 6, 8, 10, 12 of the second group are firmly, positively connected, via timing belt 22, to second drive 24. The drives 23 and 24 may be electric motors or hydraulic or pneumatic drive units. The individual rolling spindles 5, 7, 9, 11, or, respectively, 6, 8, 10, 12 are permanently engaged with their respective motor drive 23 or 24.

Figure 3:
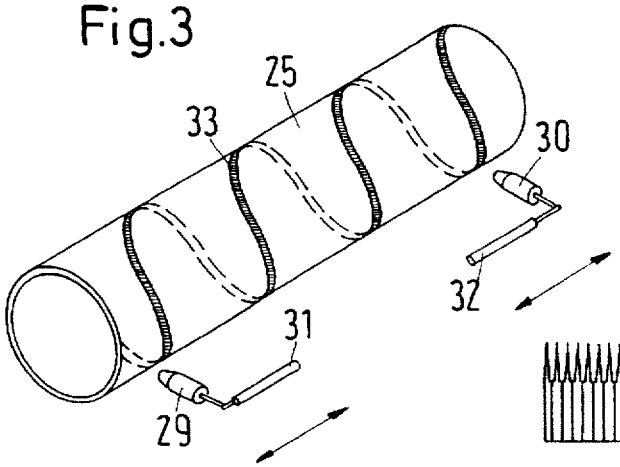
FIG. 3 is an isometric view of a glue application station.

While a given drive operates a rolling spindle in the winding station, the other spindles driven by that drive will be located in idling stations. Thus, as shown in FIG. 1, while drive 24 operates rolling spindle 5 in winding station 13 at the desired winding speed, the remaining rolling spindles 7, 9, 11 in the group turn at the same speed in idling stations 18, 19, 20. This is perfectly acceptable, however, because no further manipulation of spindles 7, 9, 11 is necessary at that time. At the same time, the rolling spindles 6, 8, 10, 12 of the other group can be operated by the other drive 23 at a different speed or could even be halted. For example, while drive 23 is stopped, the feeder station 16 can be loaded with a winding tube 25. Loading may be done in conventional fashion from a tube magazine 26 by way of a mixing device 27, which loosens the winding tubes 25, and a slide 28. Once a tube has been fed onto a spindle, the spindle may be moved into glue application station 17 by rotating carrier mount 2. Glue can then be applied to tube 25, once the tube is positioned in glue application station 17. As can be seen in FIG. 3, glue application is performed by two glue jets 29, 30, ideally of the spin-jet type, with each glue jet 29, 30 provided with an axial or linear drive 31, 32 capable of moving its respective glue jet 29, 30 parallel with the axis of the winding tube 25. While this axial movement takes place, the winding tube 25 is turned at low speed by drive 23 resulting in the application of a helical band of glue 33 on the surface of the winding tube 25. This band of glue is quite thin due to the jet-spray process. Consequently, the glue barely shows once the strip of material 34 has been attached to the winding tube 25.

Once the glue has been applied, a strip may be wound around winding tube 25 in winding station 13. The fully wound roll 35 is then positioned in the sealing station 14 where it is capped or sealed. Capping or sealing may require an angular adjustment of the roll 35, discussed further below. Finally, in the discharging station 15, a fully wound and sealed roll 36 can be discharged via a slide 37 onto a conveyor belt 38 which takes roll 36 to a packaging point. For the discharging process, drive 23 is preferably stopped.

In regular operation, all spindles 5–12 are loaded, i.e., carry a winding tube, at the same time. Accordingly, the sequence of events described above applies to each of the individual winding tubes. However, for the rolling spindles, as a whole, the sequence of processing steps in the described order is not necessarily mandatory. In many cases it will be more convenient to first seal the roll 35 that is in station 14, then discharge the sealed roll 36 that is in station 15 while at the same time feeding a fresh winding tube 25 in station 16, and ultimately applying the glue to the tube 25 that is in station 17.

During the above-described procedural stages of the pre- and post-processing of the winding tube 25 or, respectively, the rolls 35, 36, the tube 25 positioned in the winding station 13 is wound with a strip of material 34. This involves the de-reeling of the strip of material 34 off a mother roll 39 which can be decelerated by means of a motorized brake 40. The strip 34 travels over the rollers 41 toward a traction roller 42 driven by a motor 43 and optionally provided with a stamping roller 44. From the traction roller 42 the strip travels, via strip tensioner 45 which activates a centering control 46, to a pressure roller system 47 which incorporates a contact roller 48 and another roller 49 serving to briefly increase the tension on the strip of material. The contact roller 48 can be adjusted in a way that there is an air gap between it and the winding tube 25 facing it. Alternatively, the contact roller 48 can be caused to bear on the winding tube 25 at different pressure levels. The winding process proper is controlled exclusively by way of the drive controlling the specific spindle in the winding station 13, in this case drive 24. The controlling drive can thus utilize all of its power for producing the desired speed of rotation of the winding tube 25 in winding station 13.

As soon as the roll positioned in winding station 13 is fully wound, motor 3 turns carrier mount 2 by the aforementioned angular distance of 45°. The rolling spindle that was previously in the winding station 13 is thereby moved into the sealing station 14. In the process, the rolling spindle can continue to rotate at the same speed as before.

While a tube is being wound in winding station 13, another winding tube 25 is prepared in the glue application station 17. After winding of tube 25 in winding station 13 is completed, carrier mount 2 is rotated, thereby also rotating the winding tube 25 that had been in glue application station 17 out of that station, as well, and into winding station 13. The winding tube that has just entered winding station 13 can be accelerated to the desired rate of revolutions by means of its respective drive (as shown in the Figures, drive 23). This requires less power than the winding process since the drive does not have to work against the tension of the strip.

When, in the winding station 13, the winding tube 25 that is to be wound, rotating at a circumferential speed matching the strip speed, comes in contact with the strip to be wound thereon, a cutting device 50 is actuated, causing a cutter bar 51 to penetrate the strip of material 34. Winding of the tube previously in winding station 13 is thereby completed upon the cutting of the strip.

Figure 4:
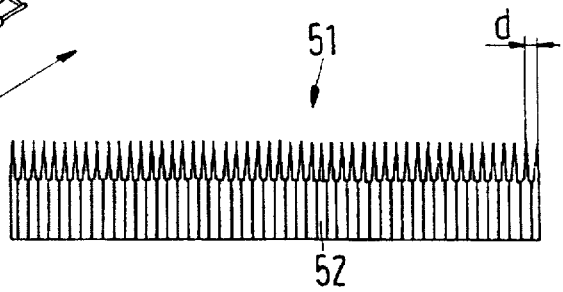
FIG. 4 is a schematic view of a cutter bar.
Figure 5:
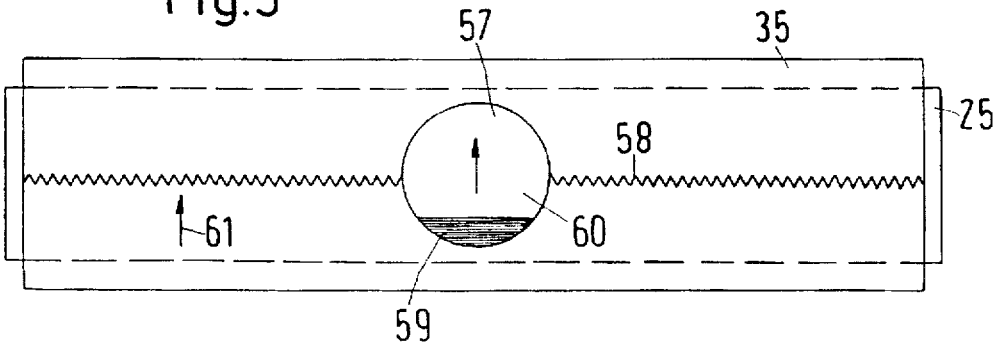
FIG. 5 is a schematic view of a finished roll complete with label.

A cutting device 50, formed in accordance with the principles of the present invention, is depicted in FIG. 4. Preferably, cutting device 50 does not have the traditional steel blade with triangular serrations, but instead has a cutter bar 51 with a large number of adjoining pins 52 with very sharp points. The points are spaced apart by a distance d of less than 1 mm and preferably about 0.5 mm. The pins 52 may be attached for instance to a common mount. When the points of the pins 52 on the cutter bar 51 penetrate the strip of material, the strip is essentially perforated and severed along the line of perforation due to the tension on the strip. This produces a relatively clean edge which, while not straight, displays only small serrations. This contrasts with conventional cutting blades which produce ever longer serrations or fringes as the winding speed is increased. The cut can be further improved by briefly increasing the tension on the strip of material 34 at the moment when, or immediately before, the cutter bar 51 penetrates the strip. This can be accomplished, for instance, by braking the roller 49.

After winding of the strip around tube 25 is completed, carrier mount 2 may be rotated to position the finished roll 35 in sealing station 14. The loose end of the strip is held by a flap 53. Since the distance of the cutting device 50 from the sealing station 14 and the circumference of the roll 35 are known factors, a control system 54, shown in schematic fashion, is now able to control the drive 23 in a way that the loose end of the strip of material on the roll 35 is positioned precisely underneath a labeling device 55 or, more specifically, underneath the label applicator 56 of the labeling device 55. This enables the label applicator 56 to place a label 57 onto the roll 35 in a way that the label 57 protrudes beyond the free, cut end 58 of the strip, thus fastening end 58 of the strip to the rest of the material around the circumference of the roll. Label 57 may include a nonsticky section 59 which is positioned over the edge of the free, cut end 58 of the strip. Nonsticky section 59 permits peeling of the label in the direction of the arrow 60 without damaging the material of the strip which is wound onto the roll 35 in the direction of the arrow 61.

The other end of the roll-fed material 34 left after cutting the material on the newly wound tube next is picked up by the next winding tube 25 to be located in the winding station 13 using what may be conventional means. The material adheres to the thin layer of glue on the winding tube 25 that was applied in the glue application station 12. While the fully wound roll 35 is being sealed, the winding process can continue for the next roll that is positioned in winding station 13. The next winding tube 25 introduced in winding station 13 is preferably brought up to the necessary rotational speed for winding before entering the winding station 13, such as in the glue application station 12. The acceleration of the winding tube approaching the winding station is performed by a drive unit different from that which operates the rotation of the tube previously in the winding station. Accordingly, the speeds of sequentially wound tubes are independently controlled and thus cannot have any negative effect on each other.

What is claimed is:

1. A device for winding a continuous strip of material reeled off a mother roll sequentially onto several winding tubes, said winding device comprising:

a carrier mount having a cyclically adjustable angle of rotation;

a motor for rotating said carrier mount;

a plurality of rolling spindles supported by said carrier mount and for carrying the winding tubes sequentially through a plurality of stations as said carrier mount is rotated;

at least two drive units for driving said rolling spindles, each of said drive units driving a plurality of rolling spindles;

wherein;

neighboring rolling spindles are driven by different driving units; and each rolling spindle is permanently engaged with its respective drive unit throughout rotation said plurality of stations.

2. A winding device as in claim 1, wherein said rolling spindles are positioned at identical angular distances around said carrier mount.

3. A winding device as in claim 1, wherein said drive units operate in alternating fashion at a higher and a lower power rate, with at least one drive unit operating at a lower power rate at any one time.

4. A winding device as in claim 3, further comprising a control system which controls said drive units as a function of the location of said spindles with respect to the stations.

5. A winding device as in claim 1, wherein said drive units permit angular positional control.

6. A winding device as in claim 1, further comprising a glue application station having at least one glue jet for applying glue to the winding tubes.

7. A winding device as in claim 6, wherein said glue jet is movable in an axial direction along the winding tube.

8. A winding device as in claim 7 wherein said spindles, at least when in said glue application station, rotate said winding tubes so that glue is helically applied about the circumference of said winding tubes.

9. A winding device as in claim 1, further comprising:

a winding station for winding a strip of material onto a winding tube in said winding station;

a cutting unit for cutting said material once a predetermined amount of material is wound on said winding tube in said winding station, said wound, cut material leaving a free, cut end; and a sealing station having a label dispenser for affixing a sealing label on the wound material and over said free, cut end of said strip of material.

10. A winding device as in claim 9, wherein said cutting unit has a multiplicity of pointed pins mounted side-by-side at a point-to-point distance of less than 1 mm.

11. A winding device as in claim 9, further comprising a strip tensioner adjacent said cutting unit for interacting with said cutting unit to temporarily increase tension of the strip of material to be cut.

12. A winding device as in claim 1, further comprising a cutting unit having a multiplicity of pointed pins mounted side-by-side at a point-to-point distance of less than 1 mm.

13. A winding device as in claim 12, further comprising a strip tensioner adjacent said cutting unit for interacting with said cutting unit to temporarily increase tension of the strip of material to be cut.

14. A winding device as in claim 13, wherein said strip tensioner increases tension of the strip of material to be cut at least at the moment said cutting device cuts said strip of material.

15. A winding device as in claim 13, wherein said strip tensioner increases tension of the strip of material to be cut just before said cutting device cuts said strip of material.

16. A winding device as in claim 1, wherein said motor rotates said carrier mount at timed intervals.

17. A winding device as in claim 1, wherein said rolling spindles are mounted on said carrier mount at essentially identical angular distances.

18. A device for winding a continuous strip of material reeled off a mother roll sequentially onto several winding tubes, said winding device comprising:

a carrier mount;

a motor for rotating said carrier mount;

a plurality of rolling spindles supported by said carrier mount and for carrying the winding tubes sequentially through a plurality of stations as said carrier mount is rotated;

at least two drive units for driving said rolling spindles, wherein neighboring rolling spindles are driven by different driving units; and a control system which controls said drive units as a function of the location of said spindles with respect to the stations;

wherein;

said drive units operate in alternating fashion at a higher and a lower power rate, with at least one drive unit operating at a lower power rate at any one time;

each said drive unit controls a plurality of rolling spindles;

said stations include a winding station, at least one processing station, and at least one idling station; and the rolling spindles driven by the drive unit driving the rolling spindle in the winding station are positioned in idling stations and not in processing stations.

19. A device for winding a continuous strip of material reeled off a mother roll sequentially onto several winding tubes, said winding device comprising:

a carrier mount;

a motor for rotating said carrier mount;

a plurality of rolling spindles supported by said carrier mount and for carrying the winding tubes sequentially through a plurality of stations as said carrier mount is rotated; and least two drive unit for driving said rolling spindle, wherein neighboring rolling spindles are driven by different driving units;

wherein;

said drive units operate in alternating fashion at a higher and a lower power rate, with at least one drive unit operating at a lower power rate at any one time;

each said drive unit controls a plurality of rolling spindles;

said stations include a winding station, at least one processing station, and at least one idling station; and the rolling spindles driven by the drive unit driving the rolling spindle in the winding station are positioned in idling stations and not in processing stations.

20. A device for winding a continuous strip of material reeled off a mother roll sequentially onto several winding tubes, said winding device comprising:

a carrier mount;

a motor for rotating said carrier mount;

a plurality of rolling spindles supported by said carrier mount and for carding the winding tubes sequentially through a plurality of stations as said carrier mount is rotated; and at least two drive units for driving said rolling spindles, wherein neighboring rolling spindles are driven by different driving units;

wherein;

each said drive unit controls a plurality of rolling spindles;

said stations include a winding station, at least one processing station, and at least one idling station; and said rolling spindles driven by the drive unit driving the rolling spindle in the winding station are positioned in idling stations and not in processing stations.

* * * * *